United States Patent [19]

Givens et al.

[11] 3,960,978

[45] *June 1, 1976

[54] CONVERTING LOW MOLECULAR WEIGHT OLEFINS OVER ZEOLITES

[75] Inventors: Edwin N. Givens, Pitman; Charles J. Plank, Woodbury; Edward J. Rosinski, Deptford, all of N.J.

[73] Assignee: Mobil Oil Corporation, New York, N.Y.

[ * ] Notice: The portion of the term of this patent subsequent to Aug. 6, 1991, has been disclaimed.

[22] Filed: Sept. 5, 1974

[21] Appl. No.: 503,420

[52] U.S. Cl. ..... 260/683.15 R; 260/673

[51] Int. Cl.[2] ..... C07C 3/20

[58] Field of Search ..... 260/683.15 R, 673.5, 260/673

[56] References Cited

UNITED STATES PATENTS

| | | | |
|---|---|---|---|
| 3,236,762 | 2/1966 | Rabo et al. | 260/683.15 R |
| 3,325,465 | 6/1967 | Jones et al. | 260/683.15 R |
| 3,756,942 | 9/1973 | Cattanach | 260/673 |
| 3,760,024 | 9/1973 | Cattanach | 260/673 |
| 3,775,501 | 11/1973 | Kaeding et al. | 260/673.5 |
| 3,827,968 | 8/1974 | Givens et al. | 260/673.5 |
| 3,845,150 | 10/1974 | Yan et al. | 260/673.5 |

*Primary Examiner*—Paul M. Coughlan, Jr.
*Attorney, Agent, or Firm*—Charles A. Huggett; Raymond W. Barclay; Claude E. Setliff

[57] ABSTRACT

Gaseous $C_2$–$C_5$ olefins, either alone or in admixture with paraffins, are converted into an olefinic gasoline blending stock with a good research octane number in good yields by passage over a ZSM-5 type zeolite catalyst of controlled acidity. The catalyst must have reduced activity for cracking of n-hexane or aromatization of olefins or paraffins if it is to be useful for the purpose of this invention.

12 Claims, No Drawings

CONVERTING LOW MOLECULAR WEIGHT OLEFINS OVER ZEOLITES

BACKGROUND OF THE INVENTION

1. Field of the Invention

This invention relates to a method of catalytically converting olefins into gasoline fractions, particularly by passing olefins over a ZSM-5 type zeolite having reduced aromatization activity.

2. Brief Description of the Prior Art

It has long been known to contact various hydrocarbon fractions with acidic catalysts generally and, in particular, with solid siliceous acidic catalysts — including those referred to as crystalline aluminosilicate zeolites. Contact of said hydrocarbon feed with said acid catalysts was carried out for a wide variety of reactions including cracking, isomerization, hydrocracking, etc. Representative U.S. patents disclosing and claiming contacting of various hydrocarbon fractions with crystalline aluminosilicates are U.S. Pat. No. 3,140,249; 3,140,251; 3,140,253; and 3,140,322.

The contact of paraffinic feedstocks with crystalline aluminosilicate zeolites is also known in the art and by far the primary reason for contacting paraffinic materials with zeolites has been for the purpose of cracking them, i.e. converting then to lower molecular weight products. Typical applications in this general field would be the use of crystalline aluminosilicate zeolites for carrying out dewaxing reactions, i.e. the cracking of paraffins to low molecular weight materials. U.S. Pat. No. 3,400,072 discloses a dewaxing process with crystalline aluminosilicates generally and copending application Ser. No. 865,470, filed Oct. 10, 1969, now U.S. Pat. No. 3,700,585, discloses and claims dewaxing operations carried out with a novel type of crystalline aluminosilicates identified as those of the ZSM-5 type.

The instant application is not concerned with hydrocarbon conversion in general, but rather, is concerned with the conversion of a hydrocarbon feed consisting essentially of $C_2$–$C_5$ olefins, mixtures thereof and mixtures thereof with paraffins. Additionally, the instant application is not concerned primarily with the cracking of these materials to still lower molecular weight products, but rather, is concerned primarily with the preparation of higher molecular weight olefins from the stated feed.

SUMMARY OF THE INVENTION

In accordance with the invention, there is provided a process for producing a gasoline fraction containing predominately olefinic compounds and preferably having a research octane number of 90 or above and having therein no more than about 20% by weight of aromatics, said process comprising contacting a $C_2$–$C_5$ olefin, mixtures thereof or mixtures thereof with paraffins preferably having from 1 to 5 carbon atoms with a ZSM-5 type crystalline aluminosilicate zeolite having an $\alpha$-value of from about 0.1 to about 120, at a WHSV of from about 0.1 to about 25 and at a temperature of from about 500°F to about 900°F, whereby said gasoline fraction containing predominantly higher olefins is obtained.

DESCRIPTION OF THE SPECIFIC EMBODIMENTS

The present invention is concerned with contacting a feed stream consisting essentially of $C_2$–$C_5$ olefins, mixtures thereof and mixtures thereof with paraffins with a ZSM-5 type crystalline aluminosilicate zeolite to obtain predominantly higher molecular weight olefins which have good octane numbers and which are excellent gasoline blending stocks. Alternatively they can, of course, be used as olefins for other chemical purposes such as conversion to alcohols, and the like. One of the prime requisites is that the zeolite have a fairly low aromatization activity, i.e. in which the amount of aromatics produced is not more than 20% by weight. This is accomplished by using ZSM-5 type zeolite with controlled acid activity [alpha ($\alpha$) value] of from about 0.1 to about 120, preferably from about 0.1 to about 100, as measured by its ability to crack n-hexane.

Alpha value are defined by a very specific test. They represent the hexane cracking activity of a given catalyst as obtained from measurements of n-hexane conversion in a pyrex glass tube micro-reactor holding up to V = 1.0 ml of catalyst material of 14–25 mesh screen size or smaller. A stream of helium at a F = 18 ml/min. flow rate was dispersed through a fritted glass disk and passed through n-hexane at 63°F. The saturated He gas stream ($P_{hexane}$ = 110 mm Hg) was passed continuously through the micro-reactor, resulting in a superficial contact time, $\iota$ = V/F, of at least $\iota$ = 3.3 seconds.

The catalysts were initially subjected to air treatment at 1000°F for 30 minutes prior to testing except for two coked samples in Example 1 where helium pretreatment was used. Conversion was observed 5 minutes after commencement of flow by diverting a gas sample from the continuous effluent stream into a vapor-chromatographic column to obtain an analysis of products and unconverted hydrocarbon.

Conversion data were considered meaningful only between 5% and 40% of n-hexane conversion. Data below 5% were rejected for analytical reasons; above 40% to avoid mass and heat transport effects, and overcracking.

Because of the wide range of magnitudes of activity encountered, conversion within a limited range was obtained by making a suitable choice of reaction temperature for each sample. At a given temperature the magnitude of the rate constant is taken as the first-order constant, $k$, from $$k = (1/\tau) ln[1/(1-\epsilon)],$$

where $\epsilon$ is the observed fractional conversion.

As a general reference catalyst, a conventional (commercial) amorphous silica-alumina cracking catalyst (Mobil Oil Corp.), obtained by cogelation was used. It contained 10 wt. % alumina, and had a specific surface area of 420 $m^2/g$. It converts 12.5% of n-hexane passed as saturated vapor (25°C) in a stream of helium over the catalyst at 1000°F with a 9 sec. superficial contact time (superficial catalyst volume/gaseous volume flow rate) at a time of 5 min. after commencement of flow. The activity of this catalyst is $\alpha$= 1 by definition.

Therefore, the ratio of relative rate constants of a catalyst ($k_x$) to the reference catalyst ($k_R$) at 1000°F is defined as the alpha of that catalyst.

$$\frac{k_x}{k_R} = \alpha$$

When the activity of the test catalyst is too high or too low to give kinetically acceptable results (i.e. give conversions in the 5–40% conversion range) at 1000°F, the comparison is made at a kinetically acceptable temperature (T) and the rate constant of the standard ($k_R$) is extrapolated to the same temperature (T) based on an Arrhenius plot with 30 Kcal/mol temperature dependence. This value of 30 Kcal/mol is an experimentally determined value for the standard catalyst. Such zeolites may be obtained by steaming, by use in a conversion process or by any other method which may occur to one skilled in this art.

Other prerequisites of the oligomerization process are:

1. temperatures between about 500° and about 900°F, preferably between about 550° and about 850°F;
2. weight hour space velocity (WHSV) between about 0.1 and about 25, preferably between about 0.5 and about 20;
3. hydrocarbon partial pressure between about 0.5 to about 40 atmospheres, preferably between about 0.5 and about 20 atmospheres; and
4. the aromatics content must be below 20%.

By maintaining the process within the stated parameters, a high level of activity can be realized with a catalyst which would otherwise not be useful from a commercial standpoint. Stated another way, the process of this invention has a very practical economic potential since the zeolite employed under the stated reaction conditions is surprisingly stable. It therefore will remain active over long periods of time, thereby eliminating the need for frequent regeneration.

ZSM-5 type zeolites include not only ZSM-5 but also ZSM-11 zeolites. ZSM-5 materials are disclosed and claimed in U.S. Pat. No. 3,702,886; ZSM-11 is disclosed and claimed in U.S. Pat. No. 3,709,979. Both of these patents are incorporated herein by reference for all they disclose concerning the synthesis and chemical and physical properties of these zeolites.

In general aspect, zeolites ZSM-5 can be suitably prepared by preparing a solution containing water, tetrapropyl ammonium hydroxide and the elements of sodium oxide, an oxide of aluminum or gallium, an oxide of silica, and having a composition, in terms of mole ratios of oxides, falling within the following ranges:

TABLE 1

| | Broad | Preferred | Particularly Preferred |
|---|---|---|---|
| $OH^-/SiO_2$ | 0.07–1.0 | 0.1–0.8 | 0.2–0.75 |
| $R_4N+/(R_4N^++Na+)$ | 0.2–0.95 | 0.3–0.9 | 0.4–0.9 |
| $H_2O/OH-$ | 10–300 | 10–300 | 10–300 |
| $YO_2/W_2O_3$ | 5–100 | 10–60 | 10–40 |

wherein R is propyl, W is aluminum and Y is silicon. This mixture is maintained at reaction conditions until the crystals of the zeolite are formed. Thereafter the crystals are separated from the liquid and recovered. Typical reaction conditions consist of a temperature of from about 75°C to 175°C for a period of about six hours to 60 days. A more preferred temperature range is from about 90° to 150°C, with the amount of time at a temperature in such range being from about 12 hours to 20 days.

The digestion of the gel particles is carried out until crystals form. The solid product is separated from the reaction medium, as by cooling the whole to room temperature, filtering and water washing.

ZSM-5 is preferably formed as an aluminosilicate. The composition can be prepared utilizing materials which supply the elements of the appropriate oxide.

Such compositions include for an aluminosilicate, sodium aluminate, alumina, sodium silicate, silica hydrosil, silica gel, silicic acid, sodium hydroxide and tetrapropylammonium hydroxide. It will be understood that each oxide component utilized in the reaction mixture for preparing a member of the ZSM-5 family can be supplied by one or more initial reactants and they can be mixed together in any order. For example, sodium oxide can be supplied by an aqueous solution of sodium hydroxide, or by an aqueous solution of sodium silicate; tetrapropylammonium cation can be supplied by the bromide salt. The reaction mixture can be prepared either batchwise or continuously. Crystal size and crystallization time of the ZSM-5 composition will vary with the nature of the reaction mixture employed.

The zeolites used in the instant invention usually have a certain proportion of the original cations associated therewith replaced by a wide variety of other cations according to techniques well known in the art. Typical replacing cations would include hydrogen, ammonium and metal cations including mixtures of the same. Of the replacing cations, particular preference is given to cations of hydrogen, Zn, Ni, Pt, Pd, Re, Cr and mixtures thereof.

Typical ion exchange techniques would be to contact the particular zeolite with a salt of the desired replacing cation or cations. Although a wide variety of salts can be employed, particular preference is given to chlorides, nitrates and sulfates.

Representative ion exchange techniques are disclosed in a wide variety of patents including U.S. Pat. Nos. 3,140,249; 3,140,251; and 3,140,253.

Following contact with the salt solution of the desired replacing cation, the zeolites may be washed with water and dried at a temperature ranging from 150°F to about 600°F and thereafter heated in air or other suitable gas at temperatures ranging from about 500°F to 1500°F for periods of time ranging from 1 to 48 hours or more.

It is also possible to treat the zeolite with steam at elevated temperatures ranging from 800°F to 1600°F and preferably 1000°F and 1500°F, if such is desired. The treatment may be accomplished in atmospheres consisting partially or entirely of steam.

A similar treatment can be accomplished at lower temperatures and elevated pressures, e.g. 350°–700°F at 10 to about 200 atmospheres.

One embodiment of this invention resides in the use of a porous matrix together with the zeolites previously described. The zeolites can be combined, dispersed or otherwise intimately admixed with a porous matrix in such proportions that the resulting product contains from 1% to 95% by weight, and preferably from 20 to 80% by weight, of the zeolite in the final composite.

The term "porous matrix" includes inorganic compositions with which the aluminosilicates can be combined, dispersed or otherwise intimately admixed wherein the matrix may be active or inactive. It is to be understood that the porosity of the compositions employed as a matrix can either be inherent in the particular material or it can be introduced by mechanical or chemical means. Representative matrices which can be employed include metals and alloys thereof, sintered metals and sintered glass, asbestos, silicon carbide aggregates, pumice, firebrick, diatomaceous earths, and inorganic oxides. Inorganic compositions especially those of a siliceous nature are preferred. Of these matrices, inorganic oxides such as clay, chemically treated clay, silica, silica-alumina, etc., are particularly preferred because of their superior porosity, attrition resistance and stability.

The compositing of the aluminosilicate with an inorganic oxide can be achieved by several methods wherein the aluminosilicates are reduced to a particle size less than 40 microns, preferably less than 10 microns, and intimately admixed with an inorganic oxide while the latter is in a hydrous state such as in the form of hydrosol, hydrogel, wet gelatinous precipitate, or in a dried state, or a mixture thereof. Thus, finely divided aluminosilicates can be mixed directly with a siliceous gel formed by hydrolyzing a basic solution of alklali metal silicate with an acid such as hydrochloric, sulfuric, acetic, etc. The mixing of the three components can be accomplished in any desired manner, such as in a ball mill or other types of mills. The aluminosilicates also may be dispersed in a hydrosol obtained by reacting an alkali metal silicate with an acid or alkaline coagulant. The hydrosol is then permitted to set in mass to a hydrogel which is thereafter dried and broken into pieces of desired shape or dried by conventional spray drying techniques or dispersed through a nozzle into a bath of oil or other water-immiscible suspending medium to obtain spheroidally shaped "bead" particles of catalyst such as described in U.S. Pat. No. 2,384.946. The aluminosilicate siliceous gel thus obtained is washed free of soluble salts and thereafter dried and/or calcined as desired.

In a like manner, the aluminosilicates may be incorporated with an aluminiferous oxide. Such gels and hydrous oxides are well known in the art and may be prepared, for example by adding ammonium hydroxide, ammonium carbonate, etc. to a salt of aluminum, such as aluminum chloride, aluminum sulfate, aluminum nitrate, etc., in an amount sufficient to form aluminum hydroxide which, upon drying, is converted to alumina. The aluminosilicate may be incorporated with the aluminiferous oxide while the latter is in the form of hydrosol, hydrogel, or wet gelatinous precipitate or hydrous oxide, or in the dried state.

The inorganic oxide may also consist of raw clay or a clay mineral which has been treated with an acid medium to render it active. The aluminosilicate can be incorporated into the clay simply by blending the two and fashioning the mixture into desired shapes. Suitable clays include attapulgite, kaolin, sepiolite, polygarskite, kaolinite, halloysite, plastic ball clays, bentonite, montmorillonite, illite, chlorite, etc.

Other useful matrices include powders of refractory oxides, such as alumina, alpha alumina, etc., having very low internal pore volume. Preferably, these materials have substantially no inherent catalytic activity of their own.

The catalyst product can be heated in steam or in other atmospheres, e.g. air, near the temperature contemplated for conversion but may be heated to operating temperatures initially during use in the conversion process. Generally, the catalyst is dried between 150°F and 600°F and thereafter may be calcined in air, steam, nitrogen, helium, flue gas or other gases not harmful to the catalyst product at temperatures ranging from about 500°F to 1600°F for periods of time ranging from 1 to 48 hours or more. It is to be understood that the aluminosilicate can also be calcined prior to incorporation into the inorganic oxide gel. It is to be further understood that the aluminosilicate or aluminosilicates need not be ion exchanged prior to incorporation in a matrix but can be so treated during or after incorporation into the matrix.

The feestock useful in the present process may be, in addition to a pure $C_2$–$C_5$ olefin, prepared mixtures thereof and mixtures with paraffins, any of a number of feeds from other sources. These include total gas streams from, for example, an FCC, TCC or Riser Cracking unit, a $C_3$- dry gas fraction from the same or different source, a $C_4$ mixture from an unsaturated gas plant, a gas stream from a coking unit and a gas stream from a pyrolysis unit.

ILLUSTRATIVE EXAMPLES

The following examples will illustrate the invention. It is to be understood they are merely illustrative and are not to be construed as limiting the scope of the invention.

The HZSM-5 used was prepared substantially in accordance with the method outlined in Example 1 of U.S. Pat. No. 3,702,886.

EXAMPLE 1

The ZSM-5 of this example was prepared by prereacting the following solutions:

A. Sodium silicate solution
42.2 lbs. Q Brand Silicate — 28.9 wt.% SiO, 8.9 wt.% $Na_2O$, 62.2 wt.% $H_2O$ 58.8 lbs. water
Sp. Gr. 1.151 at 73°F B. Acid alum solution
72.2 lbs. water
1.44 lbs. $Al_2(SO_4)_3 \cdot 18H_2O$
3.52 lbs. $H_2SO_4$
15.8 lbs. NaCl
Sp. Gr. 1.158 at 85°F These solutions were mixed together continuously through a mixing nozzle flowing the acid solution at 538 cc/min and the silicate solution at 498 cc/min forming an 8.9 pH hydrogel. This mixture was formed into bead hydrogel in the typical bead-forming method. This involves flowing the resulting hydrosol into an oil layer. The stream forms beads that gel into firm bead hydrogel. The resulting bead hydrogel was charged to a 30 gallon autoclave along with 2.8 lbs. tri-n-propyl amine and 2.44 lbs. of n-propyl bromide. This reaction mixture was allowed to react, while stirring, for 19 hours at about 275° to 320°F, forming the crystalline organoaluminosilicate, ZSM-5.

The crystalline product was separated from the supernatant liquor by filtration, followed by water washing at about 190°F to remove all soluble salts. The washed material was dried at 230°F and was calcined for 3 hours at 700°F in air to remove all carbonaceous material. The ammonium chloride base exchange of this calcined ZSM-5 consisted of 4-1 hour stirred contacts at 190°–200°F with ammonium chloride using 5 ml of 5 wt. % ammonium chloride per gram of calcined ZSM-5. The slurry was filtered after each contact, followed by water washing free of chloride ion after last contact. The washed case was subsequently dried at 230°F and re-calcined for 10 hours at 1000°F. The catalyst was pelleted, crushed and sized to 14 × 25 mesh particles.

Propylene was passed over initially fresh HZSM-5 as prepared above, at a rate of 2.8 liters per 0.7 grams of ZSM-5 per hour. The conditions of space velocity temperature and pressure were as follows:

Temperature = 600°F
Weight Hourly Space Velocity = 7
Pressure = atmospheric

The fresh catalyst ($\alpha$ 2172) in the first hour on stream gave 69.4 wt. percent liquid product containing 44 wt. % aromatics. Data are shown in Table 2. After 23 hours on stream the aromatic content in the 76 wt. percent liquid product had dropped to 20%. In 3.3 days of run time this catalyst had converted 80% of the propylene charge to liquid product. This is an increase in yield over that given by the fresh catalyst in the 1st hour on stream. The aromatic content of the liquid product had declined to approximately 5% by the end of the run. The alpha of the used catalyst as measured was 16.8. When the alpha value of a coked catalyst is determined, of course, the normal air pretreatment used in the $\alpha$ -test procedure must be avoided. So we used a flow of helium instead of air in order not to burn the coke off of this catalyst and the one in the following evaluation. The alpha value of 119 for the catalyst afer 24 hours on stream was determined by the following procedure. A duplicate of the preceding run was made with a fresh batch of HZSM-5 under identical conditions. After 24 hours on stream the run was stopped, the catalyst was removed and its alpha value was measured using a helium pretreat.

Thus with this ZSM-5 catalyst when alpha values were less than 100 we obtained good yields of oligomer product containing less than 20 wt. % aromatics but this doesn't occur with catalysts which have alpha values much greater than 100. Furthermore the liquid yields given by the catalysts with alpha values below about 120 and particularly below about 100 were much higher than for the very active fresh catalyst.

The 79 hour catalyst of this example after being regenerated in air at 1000°F had an alpha value of 2992. As a result it would again give too high a degree of aromatization to be a good oligomerization catalyst.

The results summarized in Table 2 illustrate clearly the need for controlling the initial activity of the ZSM-5 type catalyst.

The oligomerization reaction discussed herein has about a 50% greater heat of reaction than the aromatization reaction. Commercial application of either of these reactions will involve designing reactors that can remove the heat of reaction. To design a reactor suitable for both of these reactions which have very different exothermicities would be very expensive and therefore impractical. Experience has shown that a steady-state system where the heat of reaction remains nearly constant is the most preferred system. Using the equilibrated catalyst of this invention allows continued operation of a steady state system from initial start-up. Catalysts having alpha values much greater than 100 will have sharply changing heats of reaction and will therefore be impractical in a steady state equilibrated commercial unit.

Gas plants for these two reactions will differ considerably. The oligomerization produces little saturated hydrocarbons and very little $C_2$ and lighter gases, whereas the aromatization will make much more hydrogen, $C_1$ and $C_2$ hydrocarbons. The gaseous product from oligomerization of propylene is primarily $C_4$ olefin. These can be recycled to extinction. For aromatization, recycling is much more complicated in that light gases, $H_2$ and $C_1$–$C_2$ hydrocarbons, must be removed from the recycle gas. This would be a very expensive additional step.

It is obvious to those skilled in the art that to build a gas plant to handle such widely different gas compositions from the oligomerization and aromatization reactions would be impractical. The catalysts of this invention permits a gaseous composition that will remain steady.

The results of Example 1 illustrate that our preferred catalyst is one which has been permanently deactivated to an alpha value below about 120, preferably below about 100. There we saw that the very active fresh catalyst deactivated by a single run was completely reactivated by regeneration, thus becoming again unsuitable as a good oligomerization catalyst.

TABLE II

| Hours on Stream | 0 | 1 | 23 | 47 | 71 | 79 (end of run) |
|---|---|---|---|---|---|---|
| Catalysts State as defined by $\alpha$-value | Fresh 2172 | | 119 | | | 16.8 |
| Wt.% Liquid Product | | 69.4 | 76 | 83 | 82 | 80 |
| Wt.% Arom. in Liquid | | 44 | 20 | 15 | 6 | |

*Average for total run.

EXAMPLE 2

A Zn/HZSM-5 was prepared from the HZSM-5 in Example 1 above by ion exchange with $ZnCl_2$.

A slurry of 9 grams of the HZSM-5 of Example 1, 78 ml of 0.5 N $ZnCl_2$ solution and 27 ml of 0.5 N $NH_4Cl$ solution was heated at 189°–192°F while stirring for 4 hours. After filtering the cake was washed free of chloride ion and dried 75 hours at 230°F. The powder was pelleted, crushed and sized to 14 × 25 mesh particles and calcined in air for 10 hours at 1000°F. The finished catalyst contained 0.63 wt. percent zinc.

This Zn/HZSM-5 had an alpha of 124 compared to the HZSM-5 alpha of 2172. It oligomerized propylene under conditions of Example 1 to give 86 wt. % liquid product containing 24% aromatics (see Table 3). A sample of this catalyst was used in a run in which a gaseous mixture of hydrogen and $C_1$ to $C_3$ hydrocarbons ($H_2$, 0.3 wt. %; $C_1$, 4.7% $C_2$ =, 6.9%; $C_2$, 10.3%; $C_3$=, 62.4%; $C_3$, 15.4%) was aromatized at 900°–950°F for 2 cycles of 10 and 8 days interrupted by an air regeneration at 900°F for 66 hours. The spent catalyst after air regeneration at 1000°F had an alpha of 95.0. It oligomerized propylene under conditions used in Example 1 to give 84 wt. % liquid product containing about 13 wt % aromatic compounds. Therefore, this Zn/HZSM-5, whenever it had an alpha value less than 100, gave excellent yields of oligomer containing less than 20 wt. % aromatics.

EXAMPLE 3

This example also shows that permanent deactivation of an initially very active ZSM-5 type catalyst to produce an excellent oligomerization catalyst can be accomplished by using said catalyst initially in a high temperature aromatization reaction.

Cr HZSM-5 was prepared from the HZSM-5 of Example 1 by ion exchange with $CrCl_3$. A slurry containing 43.95 grams of the HZSM-5 of Example 1 and 440 ml of a 1% $CrCl_3.6H_2O$ solution was stirred and heated at 195°F for 2 hours. The solution was filtered, the cake washed free of chloride ion and dried 23 ½ hours at 230°F. After the powder was pelleted, crushed and sized to 14 × 25 mesh particles it was calcined in air for 3 hours at 1000°F. The final catalyst contained 0.046 wt. % chromium and had an alpha value of 2305 (see Table 4). A $C_2$–$C_3$ paraffin-olefin mixture (65 wt. % propylene, 15 wt. % propane, 10 wt. % ethylene, 10 wt. % ethane) was aromatized over a sample of this catalyst at 1100°F through 13 cycles.

TABLE III

Propylene Over Zn/HZSM-5

| Catalyst | HZSM-5 Fresh | Zn/HZSM-5 Fresh | Air Regen of a used Zn/HZSM-5 Aromatization Catalyst Described in Example 2 |
|---|---|---|---|
| Alpha Value (5 min) | 2172 | 124 | 95 |
| Oligomerization Test Results | | | |
| WHSV | 7.0 | 7.0 | 6.6 |
| Wt. % Liq. Prod. | 78 | 86 | 84 |
| Wt. % Arom. in Liq. | 33 | 24 | 13 |

TABLE IV

| Catalyst | Fresh Cr/HZSM-5 | After Aromatization Run of 13 cycles Described in Table 6 |
|---|---|---|
| Alpha Value (5 min) | 2305 | 9.4 |
| Oligomerization WHSV | 7.1 | 6.7 |
| Wt. % Liq. Prod. | 84 | 86 |
| Wt. % Arom. in Liq. Prod. | 25 | 10 |

The yield of liquid product in the aromatization run from the initially fresh CR/HZSM-5 catalyst was 52.7 wt. % and contained 99 wt. % aromatics. In 2 days the liquid product yield had dopped to 43 wt. %, still containing 97 wt. % aromatics. Charge was stopped and the catalyst regenerated by calcining in air first for one hour at 950°F followed by two hours at 1000°F. The regenerated catalyst was put back on stream and gave 46 wt. % liqud product containing 98 wt. % aromatics. After 12 similar cycles the freshly regenerated catalyst gave 22 wt % liquid product containing 83 Wt. % aromatics. The alpha of this freshly regenerated catalyst was 9.4 versus the 2305 for the fresh Cr/HZSM-5.

These 13 olefin aromatization cycles at 1100°F had drastically diminished the activity of the fresh catalyst for n-hexane cracking as well as for aromatication of olefins. Nevertheless, this same catalyst gave excellent results in converting propylene to higher olefins at 600°F (Table 4). An 86 wt. % liquid product containing only 10 wt. % aromatics was produced. This example shows that, even though the aromatization activity at 1100°F of ZSM-5 catalyst had markedly diminished, the oligomerization activity at 600°F remained outstanding, at the $\alpha$-value of 9.4.

EXAMPLE 4

Steaming HZSM-5 zeolites is another way to decrease the cracking and aromatization activity of these catalysts without destroying their oligomerization activity. The HZSM-5 of Example 1 after steaming at one atmosphere in 100% steam for 20 hours at 1225°F had an alpha of 2.8. At both 600 and 800°F this catalyst gave a liquid product containing 10 wt. % or less of aromatics (Table 5).

EXAMPLE 5

In this case the ZSM-5 was synthesized by first prereacting the following solutions:

A. Sodium silicate solution
94.5 lbs. of Q Brand Silicate — 28.9 wt. % $SiO_2$, 8.9 wt. % $Na_2O$, 62.2 wt. % $H_2O$ 54.9 lbs. $H_2O$ B. Acid aluminum sulfate solution
3.02 lbs. $Al_2(SO_4)_3.H_2O$(17.7% $Al_2O_3$)
7.88 lbs. $H_2SO_4$ (97%)
17.7 lbs. NaCl
560 lbs. $H_2O$ These solutions were premixed in a nozzle and then added to the stirred autoclave. To this mixture in the autoclave was added:

10 lbs. methyl ethyl ketone
6.36 lbs. tripropyl amine
5.47 lbs. n-propyl bromide and reacted in the static state, no mixing. During the organic reaction the autoclave was heated to 240°F and held for 14–15 hours to allow the organics and the gel to prereact.

The mixture was then agitated vigorously and heated to and held at 320°F for 4 ½ hours. The volatile organics were then distilled off of the mixture at this point. The crystalline product was separated from the supernatant liquor by filtration, followed by water washing at about 190°F to remove all soluble salts. The washed material was dried at 230°F and was calcined for 3 hours at 700°F in air to remove all carbonaceous material. The ammonium chloride base exchange of this calcined ZSM-5 consisted of 4-1 hour stirred contacts at 190°–200°F with ammonium chloride using 5 ml of 5 wt. % ammonium chloride per gram of calcined ZSM-5. The slurry was filtered after each contact, followed by water washing free of cloride ion after last contact. The washed case was subsequently dried at 230°F and re-calcined for 10 hours at 1000°F. A portion of this product was steamed at 1725°F for 4 hours with 100% steam at atmospheric pressure. It had an alpha value of 0.4 at 600°F propylene was converted to 35 wt. % liquid product containing 8 wt. % aromatics (see Table 5).

TABLE V

| Oligomerization Over Steamed HZSM-5 | | |
|---|---|---|
| Steaming Conditions | Example 4 | Example 5 |
| Hours/Temp.°F | 20/1225 | 4/1725 |
| Alpha | 2.8 | 0.4 |
| Run Temp., °F | 600 / 800 | 600 |
| WHSV | 7.0 / 7.0 | 7.0 |
| Liq Prod. (wt.% of charge) | 82 / 52 | 35 |
| Arom in Liq (wt.%) | 2 / 10 | 8 |

EXAMPLES 6-9

The data in Table 6 summarizes the results obtained with various charge stocks and catalysts. The catalyst in Example 6 is the HZSM-5 prepared in Example 1 steamed at 1225°F for 20 hours.

The NiHZSM-5 of Example 7 was prepared from the HZSM-5 of Example 1. The slurry of 69.2 grams of powdered HZSM-5 of Example 1 and 600 ml of 0.5N $Ni(NO_3)_2 \cdot 6H_2O$ solution was heated to 190°F and stirred for 4 hours. The slurry was filtered and water washed for 2 hours and 10 minutes to remove excess nickel. The filter cake was dried 17 hours at 230°F, pelleted and sized to 14 × 25 mesh particles and clacined for 10 hours at 1000°F. A portion (15.6g) of the above product was steamed at 1225°F for 20 hours before using in these tests. The final catalyst contained 0.23 wt. % nickel. This catalyst was also used in Examples 8 and 9.

The carbon number distribution of the liquid product from Example 7 was determined by converting the product to the corresponding saturated hydrocarbons by saturating the olefins with hydrogen over a platinum on charcoal catalyst. The resulting saturated mixture as analyzed by gas chromatography had the carbon number distrubution shown in Table 7. These data clearly show the product from this process is primarily a mixture of non-cyclic olefins from $C_4$ to $C_9$ and all carbon numbers between with a minor amount of naphthenes and/or cyclo-olefins present. The large number of olefin isomers within any carbon number series is evident from the wide distribution of paraffins within the $C_6$ and $C_7$ series shown in Table 7.

TABLE VI

| | Liquid Product Composition Example 6 | Example 7 | Example 8 | Example 9 |
|---|---|---|---|---|
| Catalyst | HZSM-5 of Example 1 Steamed 20 hours at 1225°F | Ni/HZSM-5 Steamed 20 hours at 1225°F | Catalyst of Example 7 | Catalyst of Example 7 |
| Alpha | 2.8 | 4.4 | 4.4 | 4.4 |
| Experimental Run Conditions | | | | |
| Temp., °F | 600 | 800 | 800 | 700 |
| Pressure, psig | 0 | 45 | 45 | 300 |
| WHSV (wt. chrg/wt. catalyst/hr) | 7.1 | 18.2 | 21 | 5 |
| Charge Composition | | | | |
| Propylene, wt.% | 70 | 100 | 37 | 37 |
| Propane, wt.% | 30 | | 14 | 14 |
| Butenes, wt.% | | | 26 | 26 |
| Butanes, wt.% | | | 23 | 23 |
| Liquid Product Source | 6 day composite | 20–44 hr composite | 17 hr composite | 46–100 hr composite |
| Conv. of Charge to Liq.Prod. (wt.%) | 50 | 69 | 37 | 59 |
| Liq. Prod. Comp. (wt.%) | | | | |
| Olefins (total) | 91.8 | 89.9 | 78.2 | 89.8 |
| Butenes | 15.3 | 7.2 | 4.7 | 3.9 |
| Pentenes | 3.7 | 16.2 | 13.3 | 7.5 |
| Hexene Plus | 71.6 | 65.8 | 59.9 | 78.4 |
| Paraffins (total) | 5.9 | 2.7 | 10.7 | 5.3 |
| $C_2 + C_3$ | 0.3 | 0.3 | 0.7 | 0.3 |
| $C_4 + C_5$ | 0.4 | 1.3 | 7.4 | 3.3 |
| $C_6^+$ | 5.2 | 1.1 | 2.6 | 1.7 |
| Naphthenes | 1.0 | 0.4 | 1.5 | 0.5 |
| Aromatics | 0.9 | 7.1 | 9.6 | 4.7 |

TABLE VII

| Component Distribution of Hydrogen Reduced Liq. Prod. (wt.%) From Example 7 | |
|---|---|
| Charge | $C_3$= Oligomer |
| Paraffins | |
| $C_4$ | 4 |
| $C_5$ | 20 |
| $C_6$ | 25 |
| $C_7$ | 21 |
| $C_8$ | 11 |
| $C_9$ | 3 |
| Cyclo $C_5$'s | |
| $C_6$ | 1 |
| $C_7$ | 5 |
| $C_8$ | 5 |
| $C_9$ | 0.3 |
| Cyclo $C_6$ | 1 |
| Aromatics | 4 |
| | 100 |
| $C_6$ Paraffin Isomer Distribution | |
| 2,3-Dimethylbutane | 2.4 |
| 2-Methylpentane | 9.3 |
| 3-Methylpentane | 8.3 |
| n-Hexane | 5.0 |
| Total | 25 |
| $C_7$ Paraffin Isomer Distribution | |
| 2,2-Dimethylpentane | 2.3 |
| 2,4-Dimethylpentane | 1.4 |
| 2-Methylhexane | 5.0 |
| 2,3-Dimethylpentane | 2.7 |
| 3-Methylhexane | 7.2 |
| n-Heptane | 2.4 |
| | 21 |

EXAMPLE 10

The octane of the liquid product produced in the process of this invention is shown here. The catalyst used in this example was prepared as in Example 5 except the catalyst was steamed for 20 hours at 1225°F instead of 4 hours at 1725°F. An HZSM-5 steamed 20 hours at 1225°F had an alpha value of 3.0. Propylene was passed over 1.6 grams of this catalyst at a rate of 2.9 grams per gram of catalyst per hour at 600°F and atmospheric pressure. During the period between 15 minutes and 75 minutes on stream 91.6 wt. percent of the propylene passed into the bed was converted to a liquid product having a refractive index of 1.4114. The aromatic content was no greater than 1–2 weight percent. Charge was continually passed over the catalyst for 67.5 hours. The clear research octane numbers of two liquid product samples collected from 19.5 to 43.5 hours and 43.5 to 67.5 hours were 94.7 and 94.9, respectively. Liquid recovery for the entire run was 88 weight percent.

We claim:

1. A process for producing a gasoline fraction having therein no more than about 20% by weight of aromatics, said process comprising contacting a $C_2$–$C_5$ olefin, mixtures thereof or mixtures thereof with paraffins having from 1 to 5 carbon atoms with a crystalline aluminosilicate zeolite selected from the group consisting of ZSM-5 and ZSM-11 and having an $\alpha$-value of from about 0.1 to about 120, at a WHSV of from about 0.1 to about 25 and at a temperature of from about 500°F to about 900°F, whereby said gasoline fraction containing predominantly higher olefins is obtained.

2. The process of claim 1 wherein the zeolite is ZSM-5.

3. The process of claim 1 wherein the $\alpha$-value is from about 0.1 to about 100.

4. The process of claim 1 wherein a proportion of the original cations associated with the zeolite are replaced by another cation.

5. The process of claim 4 wherein the replacing cation is a metal cation.

6. The process of claim 5 wherein the metal cation is nickel.

7. The process of claim 1 wherein the catalyst used is in the H-form.

8. The process of claim 5 wherein the replacing cation is zinc.

9. The process of claim 5 wherein the replacing cation is chromium.

10. The process of claim 1 wherein the low aromatization activity is a result of steam treating the zeolite.

11. The process of claim 1 wherein the zeolite is incorporated in a matrix.

12. The process of claim 1 wherein the gasoline fraction has a research octane number of 90 or above.

* * * * *